US011513457B2

(12) United States Patent
Sasaki

(10) Patent No.: US 11,513,457 B2
(45) Date of Patent: Nov. 29, 2022

(54) FIXING DEVICE AND IMAGE FORMING APPARATUS INCORPORATING SAME

(71) Applicant: Yoshikuni Sasaki, Kanagawa (JP)

(72) Inventor: Yoshikuni Sasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/306,305

(22) Filed: May 3, 2021

(65) Prior Publication Data

US 2021/0364959 A1 Nov. 25, 2021

(30) Foreign Application Priority Data

May 21, 2020 (JP) ..... JP2020-089077
Sep. 24, 2020 (JP) ..... JP2020-159765

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2039; G03G 15/2042; G03G 15/2053; G03G 2215/2003
See application file for complete search history.

(56) References Cited

U.S. PATENT DOCUMENTS

2008/0080912 A1 4/2008 Sawahata et al.
2012/0195653 A1 8/2012 Sasaki
2012/0282002 A1* 11/2012 Murasaki ..... G03G 15/2042 399/329
2012/0308256 A1* 12/2012 Suzuki ..... G03G 15/2042 399/92
2014/0193175 A1 7/2014 Kato et al.
2014/0270873 A1 9/2014 Kato et al.
2015/0253708 A1 9/2015 Hirose et al.
2015/0261154 A1 9/2015 Nozawa et al.
2015/0261183 A1 9/2015 Kikushima et al.
2017/0131666 A1 5/2017 Sugiyama et al.
2017/0146933 A1 5/2017 Yamano et al.
2020/0159148 A1 5/2020 Imada et al.
2020/0159149 A1 5/2020 Waida et al.
2020/0249603 A1 8/2020 Ishigaya et al.

FOREIGN PATENT DOCUMENTS

JP 2005-043655 2/2005
JP 2009-300856 12/2009
JP 2014-178509 9/2014
JP 2017-058530 3/2017

* cited by examiner

*Primary Examiner* — Thomas S Giampaolo, II
(74) *Attorney, Agent, or Firm* — Harness, Dickey & Pierce, P.L.C.

(57) ABSTRACT

A fixing device includes a heating and fixing rotator, a pressing rotator, a blower, a guide, an opening and closing device, and a driving device. The heating and fixing rotator is rotatable and heats an unfixed image on a recording medium to fix the unfixed image on the recording medium. The pressing rotator is rotatable, faces the heating and fixing rotator, and is pressed against the recording medium. The guide has an air blowing port and guides air sent from the blower to at least one of the heating and fixing rotator and the pressing rotator. The opening and closing device moves to open and close the air blowing port. The driving device includes a driver to move the opening and closing device and at least one member other than the opening and closing device and separately drives the opening and closing device and the at least one member.

22 Claims, 6 Drawing Sheets

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Applications No. 2020-089077, filed on May 21, 2020, and No. 2020-159765, filed on Sep. 24, 2020 in the Japan Patent Office, the entire disclosure of which is incorporated by reference herein.

BACKGROUND

Technical Field

Embodiments of the present disclosure generally relate to a fixing device and an image forming apparatus incorporating the fixing device.

Related Art

Image forming apparatuses such as a copier, a printer, a facsimile machine, and a multifunctional machine having two or more of copying, printing, and facsimile functions each include a fixing device including a heating rotator, which is referred to as a heating and fixing member, to fix an unfixed image to a recording medium, a pressing rotator, which is referred to as a pressing member, to press the recording medium, and other parts.

Recent image forming apparatuses can print images on various sizes of recording media from relatively large size of a recording sheet (a recording medium) such as a A3 size to a small size of the recording sheet such as a A4 or a B5 size which is frequently used. Axial lengths of the heating rotator and the pressing rotator of such an image forming apparatus need to correspond to the relatively large size such as the A3 size. When the recording sheet having the small size such as A4 or B5 passes through the fixing device in the above image forming apparatus, an effective fixing area of the heating rotator has a wide non-conveyance area on which the recording sheet having the small size does not pass.

When the above image forming apparatus continuously prints the recording sheets having the small size, a surface temperature of the non-conveyance area of the heating rotator becomes higher than a temperature of a sheet conveyance area of the heating rotator, which is called a non-conveyance area temperature rise phenomenon, because the recording sheets do not draw heat from the surface of the non-conveyance area of the heating rotator. The non-conveyance area temperature rise phenomenon causes temperature differences of members in the fixing device. Such a temperature difference may result in a poor image such as a fixing offset and trouble in a heater such as a broken heater.

SUMMARY

This specification describes an improved fixing device that includes a heating and fixing rotator, a pressing rotator, a blower, a guide, an opening and closing device, and a driving device. The heating and fixing rotator is configured to be rotatable and heat an unfixed image on a recording medium to fix the unfixed image on the recording medium. The pressing rotator faces the heating and fixing rotator and is configured to be rotatable and pressed against the recording medium. The guide has an air blowing port and is configured to guide air sent from the blower to at least one of the heating and fixing rotator and the pressing rotator. The opening and closing device is configured to move to open and close the air blowing port of the guide. The driving device includes a driver configured to move the opening and closing device and drive at least one member other than the opening and closing device. The driving device is configured to separately drive the opening and closing device and the at least one member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
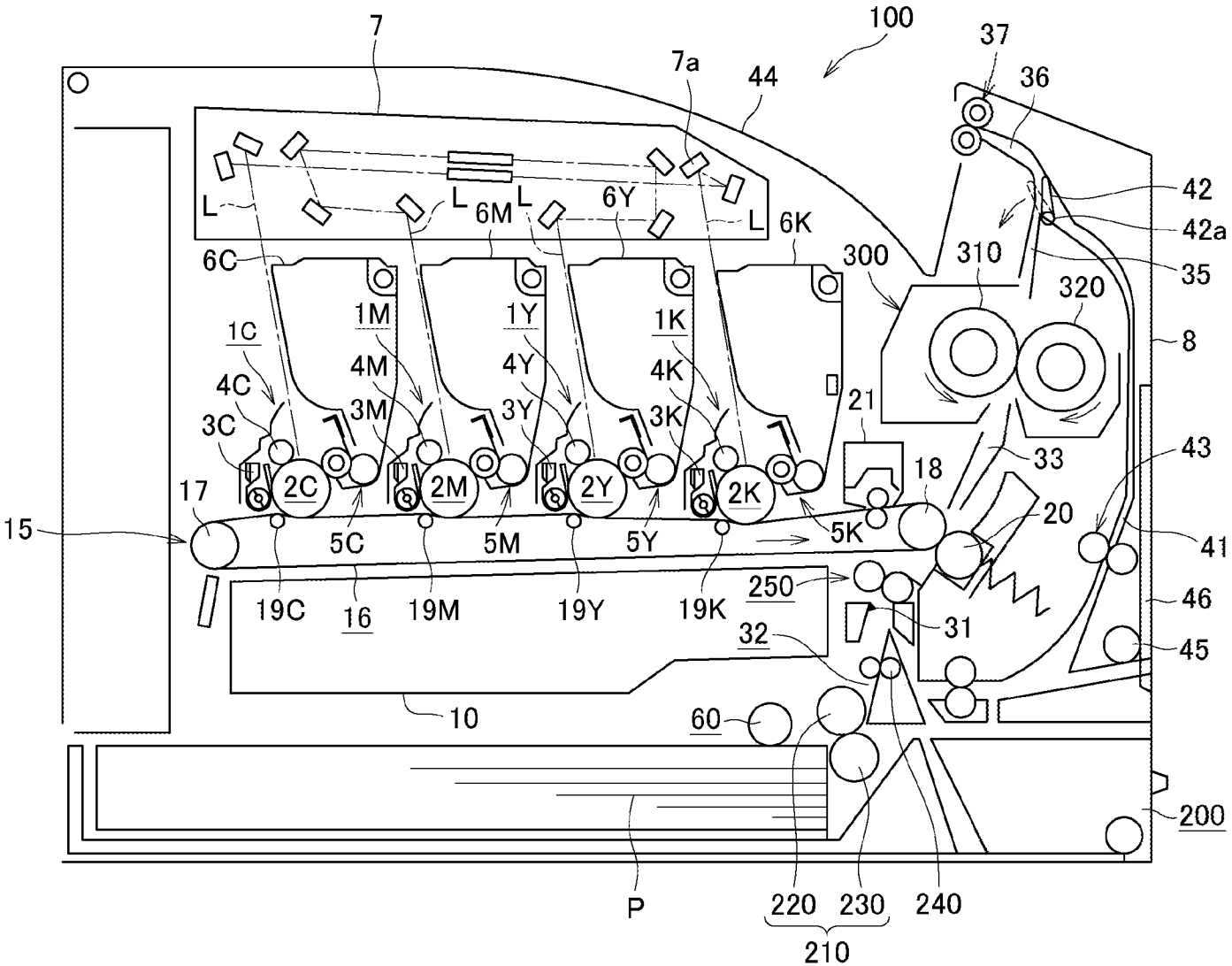
FIG. 1 is a schematic sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise.

A description is provided of a fixing device according to the present disclosure and an image forming apparatus incorporating the fixing device with reference to drawings. It is to be noted that the present disclosure is not to be considered limited to the following embodiments, but can be changed within the range that can be conceived of by those skilled in the art, such as other embodiments, additions, modifications, deletions, and the scope of the present disclosure encompasses any aspect, as long as the aspect achieves the operation and advantageous effect of the present disclosure.

The fixing device according to the present disclosure includes a heating and fixing rotator, a pressing rotator, a blower, a guide, an opening and closing device, and a driving device. The heating and fixing rotator is configured to be rotatable and heat an unfixed image on a recording medium to fix the unfixed image on the recording medium. The pressing rotator faces the heating and fixing rotator and is configured to be rotatable and pressed against the recording medium. The guide has an air blowing port and is configured to guide air sent from the blower to at least one of the heating and fixing rotator and the pressing rotator. The opening and closing device is configured to move to open and close the air blowing port of the guide. The driving device includes a driver configured to move the opening and closing device and drive at least one member other than the opening and closing device. The driving device is configured to separately drive the opening and closing device and the at least one member.

An image forming apparatus of the present disclosure includes the fixing device of the present disclosure.

The following describes a laser printer in the present embodiment according to the present disclosure, but the laser printer is one example of image forming apparatuses. The image forming apparatus according to the present disclosure is not limited to the laser printer. That is, the image forming apparatus may be a copier, a facsimile machine, a printer, a plotter, and a multifunction peripheral having at least two of copying, printing, facsimile transmission, plotting, and scanning capabilities; or an inkjet recording apparatus.

The "recording medium" is described as a "sheet" in the following embodiment but is not limited to the sheet. Examples of the "recording medium" include not only the sheet but also an overhead projector (OHP) transparency, a fabric, a metallic sheet, a plastic film, and a prepreg sheet including carbon fibers previously impregnated with resin.

Examples of the "recording medium" include all mediums to which developer or ink can adhere, and so-called recording paper and recording sheets. Examples of the "sheet" include thick paper, a postcard, an envelope, thin paper, coated paper (e.g., coat paper and art paper), and tracing paper, in addition to plain paper.

The term "image formation" used in the following description means not only giving an image such as a character or a figure to a medium but also giving an arbitrary image such as a pattern to the medium.

Figure 2:
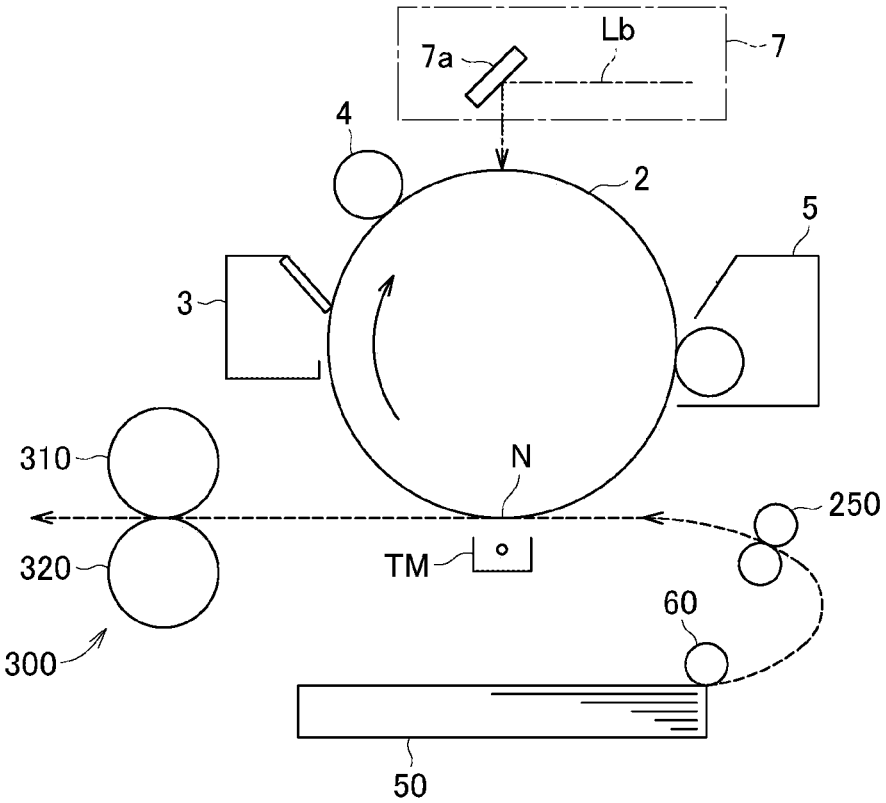
FIG. 2 is a schematic view to describe an image formation in the image forming apparatus according to an embodiment of the present disclosure.

FIG. 1 is a schematic cross-sectional view illustrating a configuration of a color laser printer as the image forming apparatus 100 according to the present embodiment. FIG. 2 is a schematic view to describe an image formation in the color laser printer.

The image forming apparatus 100 includes four process units 1K, 1Y, 1M, and 1C each as an image forming device. Suffixes K, Y, M, and C are used to indicate respective colors of toner (that is, black, yellow, magenta, and cyan) for the process units. The process units each form an image with respective developers of black (K), yellow (Y), magenta (M), and cyan (C) in color corresponding to the color separation components of a color image.

The process units 1K, 1Y, 1M, and 1C respectively include toner bottles 6K, 6Y, 6M, and 6C containing different color toners. Since the process units 1K, 1Y, 1M, and 1C have a similar structure except the color of toner, the configuration of one process unit 1K is described below as representative and descriptions of the other process units 1Y, 1M, and 1C are omitted. Thus, the configuration of the one process unit 1K is described below, and the descriptions of the other process units 1Y, 1M, and 1C are omitted.

The process units 1K, 1Y, 1M, and 1C include image bearers 2K, 2Y, 2M, and 2C such as photoconductor drums, photoconductor cleaner 3K, 3Y, 3M, and 3C and dischargers, respectively. The process units 1K, 1Y, 1M, and 1C further include charging devices 4K, 4Y, 4M, and 4C as chargers that uniformly charge the surface of the image bearers and developing devices 5K, 5Y, 5M, and 5C as developing units that render visible electrostatic latent images formed on the image bearers. The process units 1K, 1Y, 1M, and 1C are detachably attachable to a main body of the image forming apparatus 100. Consumable parts of each of the process units 1K, 1Y, 1M, and 1C can be replaced at one time.

An exposure device 7 is disposed above the process units 1K, 1Y, 1M, and 1C in the image forming apparatus 100. The exposure device 7 performs writing and scanning based on image data, that is to say, irradiates the image bearer 2K with laser light L emitted by a laser diode and reflected by mirrors 7*a* based on the image data.

A transfer device 15 is disposed below the process units 1K, 1Y, 1M, and 1C in the present embodiment. The transfer device 15 corresponds to a transfer unit TM in FIG. 2. Primary transfer rollers 19K, 19Y, 19M, and 19C are disposed opposite the image bearers 2K, 2Y, 2M, and 2C, respectively, to contact an intermediate transfer belt 16.

The intermediate transfer belt 16 is entrained around the primary transfer rollers 19K, 19Y, 19M, and 19C, a drive roller 18, and a driven roller 17 and rotates. A secondary transfer roller 20 is disposed opposite the drive roller 18 to contact the intermediate transfer belt 16. It is to be noted that, when the image bearers 2K, 2Y, 2M, and 2C are called primary image bearers, the intermediate transfer belt 16 is called a secondary image bearer to bear a synthesized image made from images formed on the respective image bearers 2K, 2Y, 2M, and 2C.

A belt cleaner 21 is disposed downstream from the secondary transfer roller 20 in a direction of rotation of the intermediate transfer belt 16. A cleaning backup roller is disposed opposite the belt cleaner 21 via the intermediate transfer belt 16.

A sheet feeder 200 including a tray loaded with sheets P is disposed below the image forming apparatus 100. The sheet feeder 200 is configured as a recording-medium supply device and can house a sheaf of a large number of recording media sheets P. The sheet feeder 200 is configured as one unit together with a sheet feed roller 60 and a roller pair 210 as a conveyor for the sheets P.

The sheet feeder 200 is detachably inserted in the main body of the image forming apparatus 100 to supply the sheet. The sheet feed roller 60 and the roller pair 210 are disposed at an upper portion of the sheet feeder 200 and convey the uppermost sheet P in the sheet feeder 200 to a sheet feeding path 32.

A registration roller pair 250 as a separation conveyor is disposed near the secondary transfer roller 20 and upstream from the secondary transfer roller 20 in a sheet conveyance direction and can temporarily stop the sheet P fed from the sheet feeder 200. Temporarily stopping the sheet P causes slack on the leading-edge side of the sheet P and corrects a skew of the sheet P.

A registration sensor 31 is disposed immediately upstream from the registration roller pair 250 in the sheet conveyance direction and detects a passage of a leading edge of the sheet. When a predetermined period of time passes after the registration sensor 31 detects the passage of the leading edge of the sheet, the sheet contacts the registration roller pair 250 and temporarily stops.

Conveyance rollers 240 are disposed downstream from the sheet feeder 200 to convey the sheet conveyed to the right side from the roller pair 210 upward. As illustrated in FIG. 1, the conveyance rollers 240 conveys the sheet to the registration roller pair 250 upward.

The roller pair 210 includes a pair of an upper roller and a lower roller. The roller pair 210 can adopt a friction reverse roller (feed and reverse roller (FRR)) separation system or a friction roller (FR) separation system.

In the FRR separation system, a separation roller (a return roller) is applied a certain amount of torque in a counter sheet feeding direction from a driving shaft via a torque limiter and pressed against a feed roller to separate sheets in the nip between the rollers. In the FR separation system, a separation roller (a friction roller) is supported by a secured shaft via a torque limiter and pressed against a feed roller to separate sheets in the nip between the rollers.

The roller pair 210 in the present embodiment is configured as the FRR separation system. That is, the roller pair 210 includes a feed roller 220 that is an upper roller of the roller pair 210 and conveys the sheet toward the image forming apparatus and a lower separation roller 230 that gives the sheet a driving force trying to move the sheet in a direction opposite the conveyance due to the feed roller 220, and the driving force is given by a driving shaft through a torque limiter.

The separation roller 230 is pressed against the feed roller 220 by a pressing member such as a spring. A clutch transmits the driving force of the feed roller 220 to the sheet feed roller 60, and the sheet feed roller 60 rotates left in FIG. 1.

The registration roller pair 250 sends the sheet P that contacts the registration roller pair 250 and has the slack on the leading-edge side of the sheet P toward the secondary transfer nip between the secondary transfer roller 20 and the drive roller 18, which is illustrated as a transfer nip N in FIG. 2, at a suitable timing to transfer the toner image formed on the intermediate transfer belt 16 onto the sheet P. A bias applied at the secondary transfer nip electrostatically transfers the toner image formed on the intermediate transfer belt 16 onto the sent sheet P at a desired transfer position with high accuracy.

A post-transfer conveyance path 33 is disposed above the secondary transfer nip between the secondary transfer roller 20 and the drive roller 18. The fixing device 300 is disposed near an upper end of the post-transfer conveyance path 33.

The fixing device 300 includes a heating sleeve 310 as the heating and fixing rotator and a pressure roller 320 as a pressing rotator that rotates while pressing against the heating and fixing rotator with a predetermined pressure. The detailed description is given later with reference to FIG. 3 and the like.

A post-fixing conveyance path 35 is disposed above the fixing device 300 and branches into a sheet ejection path 36 and a reverse conveyance path 41 at the upper end of the post-fixing conveyance path 35. At this branching portion, the switching member 42 is disposed and pivots on a pivot shaft 42*a*. At an opening end of the sheet ejection path 36, an ejection roller pair 37 is disposed.

The reverse conveyance path 41 begins from the branching portion and converges into the sheet feeding path 32. Additionally, a reverse conveyance roller pair 43 is disposed midway in the reverse conveyance path 41. An upper face of the image forming apparatus 100 is recessed to an inner side of the image forming apparatus 100 and serves as an output tray 44.

A powder container 10 such as a toner container is disposed between the transfer device 15 and the sheet feeder 200. The powder container 10 is removably installed in the apparatus body of the image forming apparatus 100.

Suitable sheet conveyance in the image forming apparatus 100 according to the present embodiment needs a predetermined length from the sheet feed roller 60 to the secondary transfer roller 20. The powder container 10 is disposed in a dead space caused by that distance to keep the entire image forming apparatus compact.

Figure 3:
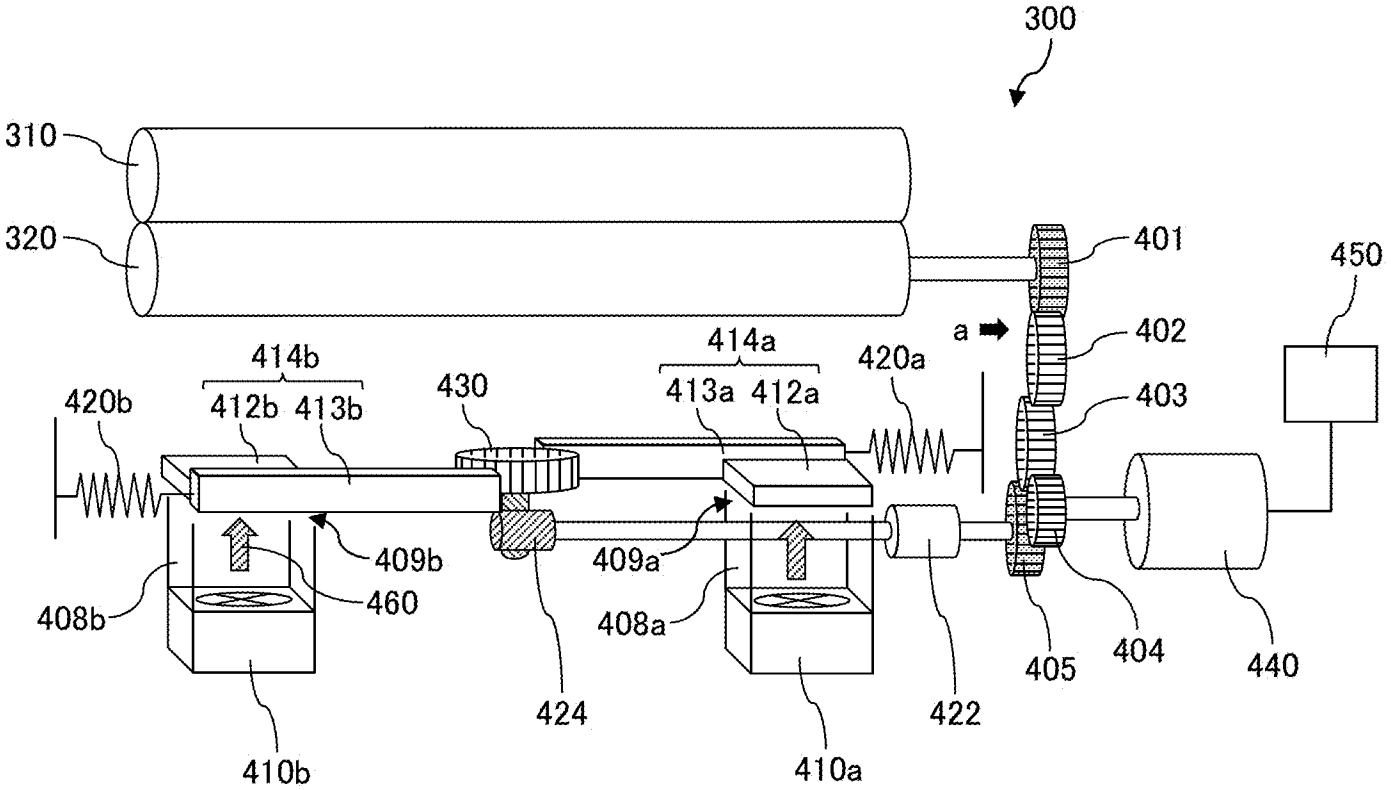
FIG. 3 is a schematic view illustrating a fixing device in which an air blowing port is closed in the embodiment of the present disclosure.
Figure 4:
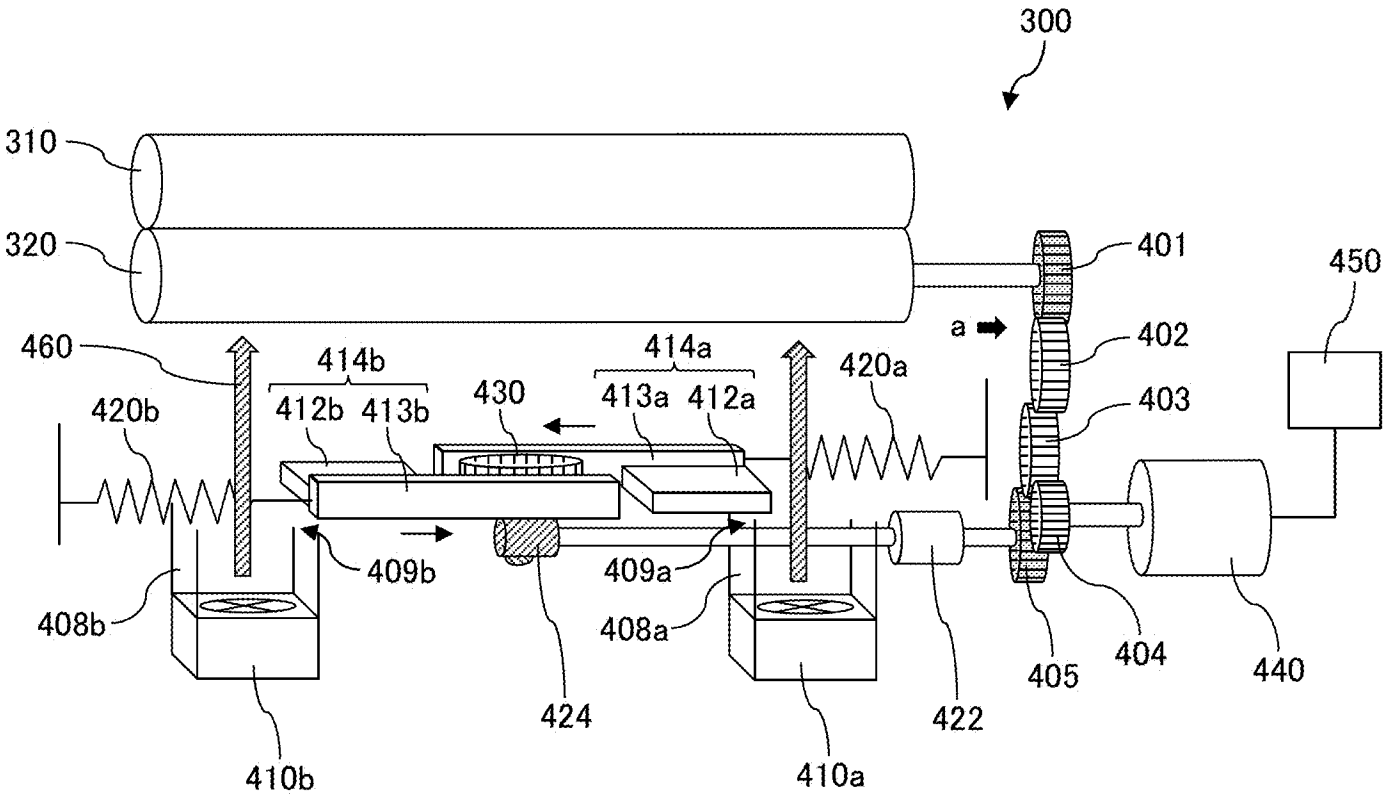
FIG. 4 is a schematic view illustrating the fixing device in which the air blowing port is opened in the embodiment of the present disclosure.

A transfer cover 8 is disposed above the sheet feeder 200 and on a front side to which the sheet feeder 200 is pulled out. The transfer cover 8 can be opened to check an interior of the image forming apparatus 100. The transfer cover 8 includes a manual sheet feed roller 45 for manual sheet feeding and a manual sheet feeding tray 46 for the manual sheet feeding. FIGS. 3 and 4 are schematic views illustrating the fixing device according to the present embodiment. FIG. 3 illustrates the opening and closing device at an initial position closing the air blowing port. FIG. 4 illustrates the opening and closing device at an opening position opening the air blowing port.

As illustrated in FIGS. 3 and 4, the fixing device according to the present embodiment includes the heating sleeve 310, the pressure roller 320, a blower fan 410, a blower duct 408, a shutter 414, and a motor 440.

The heating sleeve 310 is rotatable and is one example of the heating and fixing rotator configured to heat the recording medium and fix the unfixed image on the recording medium to the recording medium. The heating and fixing rotator is not limited to the heating sleeve, and a fixing belt or the like may be used.

A heater such as a halogen heater is disposed inside the heating sleeve 310, and the heating sleeve 310 transmits heat from the heater to the recording medium. The heater may not be disposed inside the heating sleeve 310 but may be disposed outside the heating sleeve 310.

The pressure roller 320 faces the heating sleeve 310 and is one example of the pressing rotator facing the heating and fixing rotator and configured to be pressed against the recording medium. In the present embodiment, the heating sleeve 310 and the pressure roller 320 contact each other to form a fixing nip. The recording medium bearing the unfixed image is conveyed to the fixing nip to fix the unfixed image to the recording medium. In the present embodiment, the pressure roller 320 receives a driving force from the motor 440 serving as a rotation driver through gear connection to convey the recording medium at the fixing nip. The fixing device in the present embodiment includes gears 401 to 405 transmitting the driving force from the motor 440 to the gear 404, the gear 403, the gear 402, and the gear 401 in this order to rotate the pressure roller 320. The number, arrangement, and the like of the gears are not limited to those illustrated in drawings and may be appropriately changed.

The blower fans 410*a* and 410*b* are one example of the blower that blows air to at least one of the heating sleeve 310 and the pressure roller 320. When the blower fans 410*a* and 410*b* are described without distinction, each of them is simply referred to as the blower fan 410. The blower fan 410 can cool the none-conveyance area of at least one of the heating sleeve 310 and the pressure roller 320 on which the recording medium does not pass.

When the heating sleeve 310 and the pressure roller 320 fix the unfixed image to the recording medium, heat is transferred from sheet conveyance areas of the heating sleeve 310 and the pressure roller 320 through which the recording medium passes to the recording medium passing through the fixing nip. Thus, the temperature decreases in the sheet conveyance areas of the heating sleeve 310 and the pressure roller 320. In contrast, since heat is not transferred from the non-conveyance area of the heating sleeve 310 and the pressure roller 320 through which the recording medium does not pass to the recording medium, the temperature rises in the non-conveyance areas of the heating sleeve 310 and the pressure roller 320. In this case, temperature difference occurs in a longitudinal direction of the pressure roller 320 and may cause an image defect, a failure of the heater, or the like.

In the present embodiment, the blower fans 410*a* and 410*b* are disposed facing both end portions of the pressure roller 320 in the longitudinal direction of the pressure roller 320 and blow air 460 to the pressure roller 320 in FIGS. 3 and 4. In FIG. 3, the air blowing port 409 is closed, and the air 460 is not sent to the pressure roller 320. In FIG. 4, the air blowing port 409 is opened, and the air 460 is sent to the pressure roller 320. The air 460 sent to the pressure roller 320 can lower the temperature in the non-conveyance areas of the heating sleeve 310 and the pressure roller 320 and reduce their temperature differences.

In the present embodiment, the blower fans 410*a* and 410*b* blow air to the pressure roller 320, but the present disclosure in not limited to this. The blower may blow the air to the heating sleeve 310 or both the heating sleeve 310 and the pressure roller 320.

In addition, the number of the blower fans 410 is two in the present embodiment but is not limited to this in the present disclosure. The number of the blower may be appropriately changed. For example, the fixing device 300 may include one blower fan 410 and the blower duct 408 of which the shape is appropriately changed to have divided paths, for example, two paths to blow the air to the heating sleeve 310 and the pressure roller 320. The switching timing of the blower fan 410 may be appropriately changed. For example, the blower fan 410 may be turned on when the air blowing port 409 is open.

The blower fans 410 are preferably disposed facing both ends of the pressure roller 320 in the longitudinal direction of the pressure roller 320 as in the present embodiment. However, the position of the blower is not limited to this. Preferably, the blowers are disposed facing the both ends of the pressure roller 320 in the longitudinal direction of the pressure roller 320 to blow the air to the non-conveyance areas of at least one of the pressure roller 320 and the heat sleeve 310. This configuration can cool the non-conveyance areas and reduce the temperature difference.

The blower duct 408 is one example of the guide having the air blowing port 409 and configured to guide the air 460 blown from the blower fan 410 to at least one of the heating sleeve 310 and the pressure roller 320. The blower duct 408 is formed to connect the pressure roller 320 and the blower fan 410. Corresponding to the blower fan 410*a*, a blower duct 408*a* is disposed in the fixing device 300. Corresponding to the blower fan 410*b*, a blower duct 408*b* is disposed in the fixing device 300. When the blower ducts 408*a* and 408*b* are described without distinction, each of them is simply referred to as the blower duct 408.

As illustrated in FIGS. 3 and 4, the blower duct 408*a* has an air blowing port 409*a*, and the blower duct 408*b* has an air blowing port 409*b*. When the air blowing ports 409*a* and 409*b* are described without distinction, each of them is simply referred to as the air blowing port 409.

The shutter 414 is disposed on the blower duct 408 to cover the air blowing port 409. The fixing device 300 in the present embodiment includes two shutters 414*a* and 414*b*. As illustrated in FIGS. 3 and 4, the shutter 414*a* corresponds to the air blowing port 409*a*, and the shutter 414*b* corresponds to the air blowing port 409*b*. When the shutters 414*a* and 414*b* are described without distinction, each of them is simply referred to as the shutter 414.

The air blowing port 409 may be in an intermediate portion of the blower duct 408. That is, the blower duct 408 may be further formed ahead of the air blowing port 409. The air blowing port 409 may be in the intermediate portion of the blower duct 408 or an end of the blower duct 408. The shape of the blower duct 408 may be appropriately changed.

The shutter 414 is one example of the opening and closing device configured to drive so as to open and close the air blowing port 409 of the blower duct 408. In the present embodiment, the shutter 414 includes a shield 412 and a support 413. As illustrated in FIGS. 3 and 4, the shield 412 and the support 413 move as a unit. In FIG. 3, the shutter 414 closes the air blowing port 409. In FIG. 4, the shutter 414 opens the air blowing port 409.

The shutter 414*a* includes a shield 412*a* and a support 413*a*, and the shutter 414*b* includes a shield 412*b* and a support 413*b*. When the shields 412*a* and 412*b* are described without distinction, each of them is simply referred to as the shield 412. When the supports 413*a* and 413*b* are described without distinction, each of them is simply referred to as the support 413.

The opening and closing device according to the present disclosure is not limited to the shutter illustrated in FIGS. 3 and 4 and may be appropriately changed. The opening and closing device may be the shield 412, that is, may not include the support 413. The opening and closing device may include a member other than the shield 412 and the support 413.

In the present embodiment, a spring 420 has a function to return the shutter 414 to the initial position. When the driving force is not applied to the shutter 414, the shutter 414 is fixed in the initial position by the force of the spring 420 as illustrated in FIG. 3. When the driving force is applied to the shutter 414, the shutter 414 moves to an opening position to open the air blowing port 409 as illustrated in FIG. 4.

Corresponding to the shutter 414*a*, the spring 420*a* is disposed in the fixing device 300. Corresponding to the shutter 414*b*, the spring 420*b* is disposed in the fixing device 300. When the springs 420*a* and 420*b* are not distinguished from each other, each of them is referred to as the spring 420.

In the present embodiment, the shutter 414 is moved by a shutter moving gear 430, a holder 422, and a gear mover 424, which are illustrated in FIGS. 3 and 4. The shutter moving gear 430 is, for example, a gear and rotates to move the support 413. The holder 422 holds, for example, a shaft of an electromagnetic brake or the like and is disposed in a middle portion of a transmission portion such as a shaft to transmit the driving force from the motor 440 to the shutter moving gear 430. The gear mover 424 is a member to transmit the driving force from the motor 440 to the shutter moving gear 430 and is configured by, for example, a bevel gear, a screw gear, or a worm gear to change the rotation direction of the transmission portion to a right angle and transmit the driving force to rotate the shutter moving gear 430.

An example of processes to move the shutter 414 is described below. First, the brake of the holder 422 is released. Then, the force of the spring 420 automatically returns the shutter 414 to the initial position (that is the position in FIG. 3). Next, driving the motor 440 rotates the gears 404, 403, and 405 to transmit the driving force to the gear mover 424. The gear mover 424 rotates the shutter moving gear 430 that engages and moves the support 413 of the shutter 414. As a result, the shutter 414 opens the air blowing port 409.

Figure 5A:
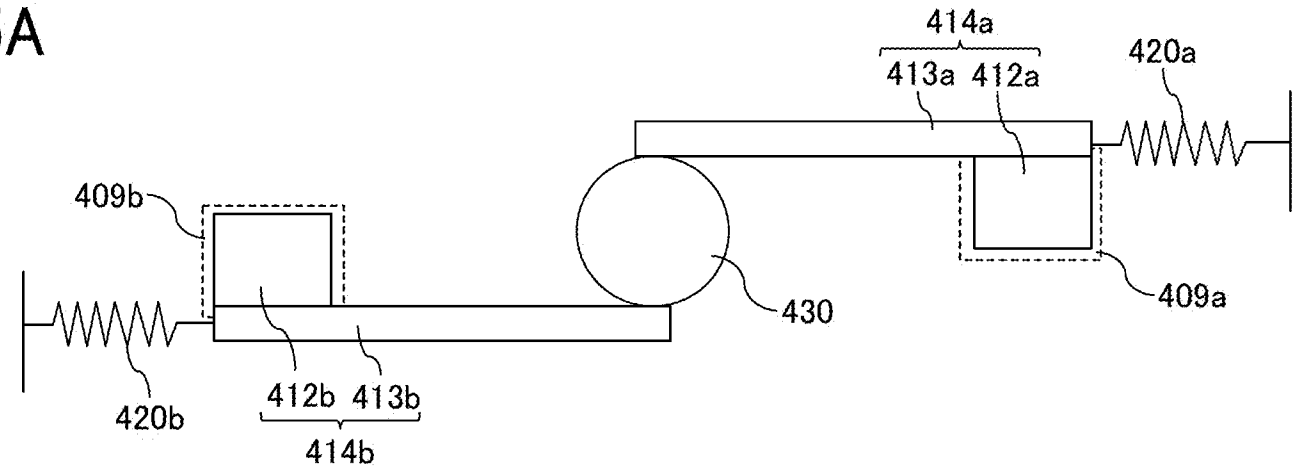
FIGS. 5A and 5B are schematic views illustrating movements in an opening and closing device to open and close the air blowing port in the fixing device of FIGS. 3 and 4.
Figure 5B:
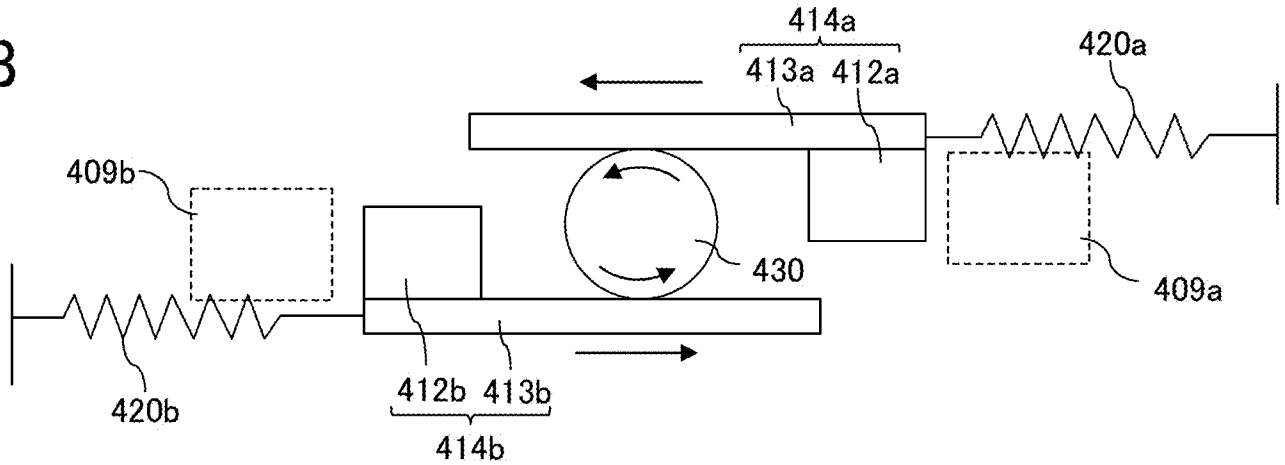

The movement of the shutter moving gear 430 and the shutter 414 as described above is schematically illustrated in FIGS. 5A and 5B. FIGS. 5A and 5B are schematic views of a main part of the fixing device 300 viewed from an upper position in FIGS. 3 and 4. FIG. 5A illustrates the initial position of the shutter 414 to close the air blowing port 409. The above-described sequential processes transmits the driving force from the motor 440 to the shutter moving gear 430, and the shutter moving gear 430 rotates in a direction indicated by arrow in FIG. 5B to move the shutter 414 as indicated by the arrow. Thus, the air blowing port 409 is opened.

Preferably, the shutter 414 moves in the rotation axis direction of the pressure roller 320 that may be referred to as the longitudinal direction of the pressure roller 320 as in the present embodiment. Moving the shutter 414 in the longitudinal direction enables easy adjustment of an opening area of the air blowing port 409. In addition, the configuration in the present embodiment opens the air blowing port 409 from an end of the air blowing port 409 facing an end of the pressure roller 320, which enables easy adjustment corresponding to the size of the recording medium.

The fixing device 300 according to the present embodiment may include a controller 450 configured to determine the opening area of the air blowing port 409 of the blower duct 408 based on the size of the recording medium and control the movement distance of the shutter 414 in accordance with the determined opening area. The above-described controller 450 enables blowing the air to the non-conveyance area corresponding to the size of the recording medium and avoids blowing the air to the sheet conveyance area and not blowing the air to a part of the non-conveyance area. The controller and the opening and closing device according to the present embodiment can arbitrarily change an opening width of the air blowing port 409, accurately blowing the air to the non-conveyance area to cool the non-conveyance area.

An example of the control is described below. When recording media having a relatively small size continuously pass through the fixing device 300, the controller 450 opens the air blowing port to blow the air to the non-conveyance area. In contrast, when recording media having a large size continuously pass through the fixing device 300, the controller 450 closes the air blowing port.

The controller 450 can appropriately select from various kinds of manners. For example, the controller 450 may include a central processing unit (CPU) or the like that controls the drive of the motor to control the movement distance of the shutter 414. The controller may be formed as a module in the fixing device or may be disposed separately from the fixing device. The controller may use an electromagnetic clutch and a motor rotating in one direction. Switching the electromagnetic clutch enables the motor to drive the opening and closing device and another member. The motor may rotate in two directions.

In addition to the above, the controller 450 may receive data about a size of the recording medium from another device, determine the opening area of the air blowing port 409 based on the size of the recording medium, and rotation steps or rotation time of the motor 440 to control the position of the shutter 414.

When the shutter 414 moves to the opening position, the brake of the holder 422 is applied to fix the position of the shutter 414. While the position of the shutter 414 is fixed, the motor 440 may rotate or not.

Preferably, the controller 450 in the present embodiment does not use a sensor to detect the position of the shutter 414 when the controller 450 controls the position of the shutter 414 or the movement distance of the shutter 414. To avoid using the sensor, the controller 450 drives a motor that can be controlled with high accuracy, such as a stepping motor, as the motor 440. Since the controller 450 can accurately control the position of the shutter 414 based on the rotation steps or the rotation time of the motor described above, the sensor to detect the position of the shutter 414 can be omitted.

An optical sensor is often used to detect a position of a member but has low heat resistance which easily causes a failure. Omitting the sensor to detect the position eliminates the cause of the failure and the harness routed to the sensor, which improves the reliability and reduces the cost.

The motor 440 is one example of the driver configured to drive the shutter 414 and a member other than the shutter 414.

The motor 440 drives at least one member or more members other than the shutter 414. In the present embodiment, the motor 440 drives the pressure roller 320 as an example, but the present disclosure is not limited to this. For example, the motor 440 may drive the heating sleeve 310 or a plurality of members.

In the present embodiment, the motor 440 serves as both the driver to move the shutter 414 and the driver to drive the member other than the shutter 414, for example, the pressure roller 320. The motor 440 can drive the shutter 414 and the member other than the shutter 414 separately. The above-described configuration can open and close the air blowing port without a dedicated driving mechanism and reduce the cost. A method of separately driving the shutter 414 and the member other than the shutter 414 can be appropriately selected, and details thereof is described later.

Preferably, the motor 440 drives the pressure roller 320 as the member other than the shutter 414. In this case, the driver to move the shutter 414 is the same as the driver to drive the pressure roller 320. In many cases, the fixing device requires the driver of the pressure roller 320, and using the driver of the pressure roller 320 to move the shutter 414 can provide a configuration having a necessary minimum number of the drivers.

In the present embodiment, the driving force of the motor 440 is transmitted to the shutter 414 and the pressure roller 320 via the gears 401 to 405. The motor 440 is one example of the driver, and the motor 440 and the gears 401 to 405 collectively configure one example of the driving device.

The fixing device according to the present embodiment includes a driving force transmitter such as the gear 405 that transmits the driving force to the opening and closing device such as the shutter 414. The driving force transmitter can be rotated in a plurality of directions. Preferably, the driving force transmitter transmits the driving force to the opening and closing device only when the driving force transmitter is rotated in a predetermined direction. The above-described configuration can use the driver of the member other than the opening and closing device to move the opening and closing device. That is, the above-described configuration can open and close the air blowing port 409 of the blower duct 408 without a dedicated driver when air is blown to the pressure roller 320, the heating sleeve 310, and the like. As a result, The above-described configuration can eliminate the dedicated driver such as a motor only for opening and closing the air blowing port 409, a control circuit for the dedicated driving mechanism, a harness to transmit signals, and the like and significantly reduce the cost.

As described above, the shutter 414 in the present embodiment preferably moves to the opening position after returning to the initial position. That is, the shutter 414 is configured to be movable between the initial position in which the shutter 414 closes the air blowing port 409 of the blower duct 408 and the opening position in which the shutter 414 opens the air blowing port 409 of the blower duct 408. When the shutter 414 moves to the opening position to open the air blowing port 409 of the blower duct 408, preferably, the shutter 414 firstly returns to the initial position and then moves to the opening position. In the above-described configuration, moving the shutter 414 after returning to the initial position enables the shutter 414 to move to an arbitrary position even when the driving force from the driving device is applied in one direction.

Examples of the driving force transmitter to transmit the driving force to the shutter 414 include gears 403 to 405 in the present embodiment, and mainly the gear 405 functions as the driving force transmitter. The gear 405 can rotate clockwise and counterclockwise and transmits the driving force to the shutter 414 only when the gear 405 rotates, for example, counterclockwise. The above-described configuration may be appropriately changed.

Preferably, the gear 405 includes a one-way clutch. The one-way clutch is a simple configuration in which rotations in a predetermined one direction transmits the driving force to the shutter 414.

In addition, the fixing device in the present embodiment may include a driving force transmitter to transmit the driving force to the member other than the shutter 414, and the driving force transmitter may be configured to be able to rotate in a plurality of directions. Preferably, the driving force transmitter configured to rotate in the plurality of directions transmits the driving force to the member other than the shutter 414 only when the driving force transmitter rotates in a predetermined direction.

An example of the member other than the shutter 414 is the pressure roller 320 in the present embodiment, the driving force transmitter to transmit the member other than the shutter 414 includes the gears 401 to 404, and the gear 401 mainly functions as the driving force transmitter. The above-described driving device in which the gear 401 transmits the driving force to the pressure roller 320 only when rotated in a predetermined direction is simple and enables the driver to move the shutter 414 and drive the member (that is, the pressure roller 320) other than the shutter 414.

Preferably, the driving force transmitter such as the gear 401 to transmit the driving force to the member other than the shutter 414 includes a one-way clutch. The one-way clutch is a simple configuration in which rotations in a predetermined direction transmits the driving force to the member other than the shutter 414 (that is, the pressure roller 320). In the present embodiment, the gear 401 and the gear 405 each have the one-way clutch.

Figure 6:
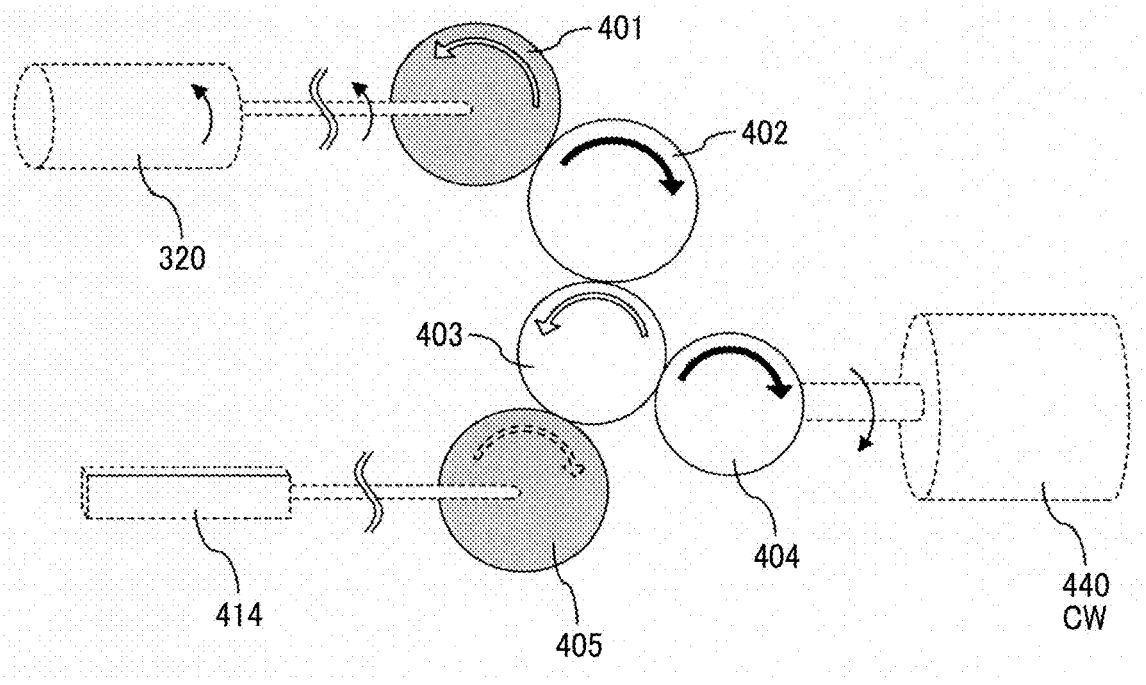
FIG. 6 is a schematic view illustrating a main part to drive a pressure roller in the fixing device of the embodiment of the present disclosure.
Figure 7:
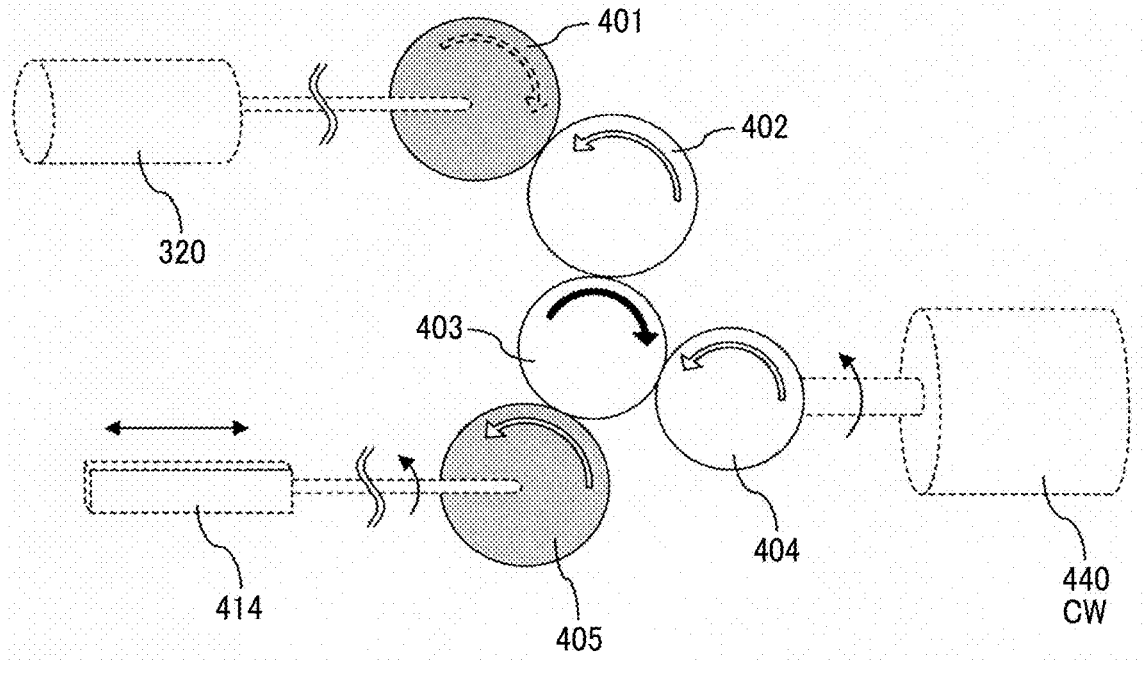
FIG. 7 is a schematic view illustrating a main part to drive a shutter in the fixing device of the embodiment of the present disclosure.

With reference to FIGS. 6 and 7, an example of the driving device is described below. FIGS. 6 and 7 are schematic views of the driving device in the fixing device according to the present embodiment and illustrate a schematic configuration of the driving device viewed from a direction indicated by arrow a in FIGS. 3 and 4. FIGS. 6 and 7 schematically illustrate rotational directions of the gear 401 to 405. In FIG. 6, the motor 440 rotates clockwise to rotate the pressure roller 320. In FIG. 7, the motor 440 rotates counterclockwise to move the shutter 414.

As illustrated in FIGS. 3 and 4, the pressure roller 320, the shutter 414, and the motor 440 are not disposed on the same plane as the gears 401 to 405 but are indicated by broken lines in FIGS. 6 and 7 for description.

As illustrated in FIGS. 6 and 7, the motor 440 rotates the gears 401 to 405 to transmit the driving force. In FIGS. 6 and 7, black arrows in the gears 401 to 405 illustrate clockwise rotation, and white arrows illustrate counterclockwise rotation. In the example illustrated in FIG. 6, the motor 440 rotates the gear 404, and the gear 404, the gear 403, the gear 402, and the gear 401 transmit the driving force from the motor 440 in this order to drive the pressure roller 320. In FIG. 7, the motor 440 rotates the gear 404, and the gear 404, the gear 403, and the gear 405 transmit the driving force from the motor 440 in this order to drive the shutter 414.

When the fixing device 300 conveys the recording medium to fix the image to the recording medium, the motor 440 rotates clockwise to rotate the pressure roller 320 as illustrated in FIG. 6. The gear 401 includes the one-way clutch that transmits the driving force only when the gear 401 is rotated in counterclockwise. The clockwise rotation in the motor 440 rotates the gear 401 counterclockwise as illustrated in FIG. 6. Thus, the gear 401 transmits the driving force to the pressure roller 320 to rotate the pressure roller 320. The gear 405 to transmit the driving force to the shutter 414 also includes the one-way clutch that transmits the driving force only when the gear 405 is rotated in counterclockwise. The clockwise rotation in the motor 440 rotates the gear 405 clockwise as illustrated by a broken-line arrow in FIG. 6. Thus, the gear 405 does not transmit the driving force to the shutter 414. Therefore, the pressure roller 320 is driven to rotate, but the shutter 414 does not move.

In contrast, when the shutter 414 is moved to blow air, the motor 440 rotates counterclockwise to move the shutter 414 as illustrated in FIG. 7. Since the counterclockwise rotation in the motor 440 rotates the gear 405 counterclockwise, the gear 405 transmits the driving force to the shutter 414 and move the shutter 414. Since the counterclockwise rotation in the motor 440 rotates the gear 401 to transmit the driving force to the pressure roller 320 clockwise as indicated by a dashed arrow in FIG. 7, the gear 401 does not transmit the driving force to the pressure roller 320.

As described above, it is preferable that a direction to transmit the driving force to drive the opening and closing device is different from a direction to transmit the driving force to drive the member other than the opening and closing device. That is, for example, clockwise rotation in the motor 440 drives the pressure roller 320, and counterclockwise rotation in the motor 440 drives the shutter 414. The above-described configuration does not move the shutter 414 while the motor 440 drives the pressure roller 320. In contrast, when the shutter 414 moves, the driving force is not transmitted to the pressure roller 320. As a result, the above-described configuration can omit the dedicated driver to drive the shutter 414.

The number, arrangement, and the like of the gears are not limited to those illustrated in drawings and may be appropriately changed. For example, the number of gears may be increased or decreased from the illustrated example.

As described above, the configuration illustrated in the present embodiment uses the driver of the member other than the opening and closing device to move the opening and closing device. That is, the above-described configuration can open and close the air blowing port 409 without the dedicated driver when the air is blown to the pressure roller 320, the heating sleeve 310, and the like. As a result, the above-described configuration can reduce the cost.

A long-life part such as the motor or the fan having a longer life than the heater of the fixing device may be disposed in the main body of the image forming apparatus. Disposing the long-life part in the main body of the image forming apparatus reduce life-cycle cost when the fixing device is replaced as a replacement unit.

On the other hand, a short-life part such as the one-way clutch or a shutter mechanism having a shorter life than the main body of the image forming apparatus may be disposed in the fixing device. Disposing the short-life part in the fixing device enables periodic replacement of the short-life part at the timing of replacing the fixing device.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Each of the functions of the described controller in the present embodiments may be implemented by one or more processing circuits or circuitry. Processing circuitry includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

What is claimed is:

1. A fixing device comprising:

a pair of rotators including a heating and fixing rotator and a pressing rotator, the heating and fixing rotator configured to be rotatable and heat an unfixed image on a recording medium to fix the unfixed image on the recording medium, the pressing rotator facing the heating and fixing rotator and configured to be rotatable and pressed against the recording medium;

a blower;

a guide having an air blowing port and configured to guide air sent from the blower to at least one of the heating and fixing rotator and the pressing rotator;

an opening and closing device configured to move to open and close the air blowing port of the guide; and a driving device including a driver configured to move the opening and closing device and to drive one or more of the pair of rotators, the driving device being configured to separately drive the opening and closing device and the one or more of the pair of rotators.

2. The fixing device according to claim 1, wherein the driver is configured to drive the opening and closing device and the pressing rotator.

3. The fixing device according to claim 1, wherein the opening and closing device is configured to move between an initial position at which the opening and closing device closes the air blowing port of the guide and an opening position at which the opening and closing device opens the air blowing port of the guide, and wherein the opening and closing device is configured to return to the initial position when a driving force is not applied thereto.

4. The fixing device according to claim 1, wherein the opening and closing device moves in a rotation axis direction of the pressing rotator.

5. The fixing device according to claim 1, further comprising a driving force transmitter configured to be rotatable in a plurality of directions and rotate in one of the plurality of directions to transmit a driving force to the opening and closing device.

6. The fixing device according to claim 5, wherein the driving force transmitter includes a one-way clutch.

7. The fixing device according to claim 1, further comprising a driving force transmitter configured to be rotatable in a plurality of directions and rotate in one of the plurality of directions to transmit a driving force to the one or more of the pair of rotators.

8. The fixing device according to claim 7, wherein the driving force transmitter includes a one-way clutch.

9. An image forming apparatus comprising the fixing device according to claim 1.

10. The fixing device according to claim 1, wherein the air blowing port includes a pair of air blowing ports, and the driver is configured to move a pair of shields included in the opening and closing device to simultaneously open respective ones of the pair of air blowing ports.

11. An image forming apparatus comprising:

a pair of rotators including a heating and fixing rotator and a pressing rotator, the heating and fixing rotator configured to be rotatable and heat an unfixed image on a recording medium to fix the unfixed image on the recording medium, the pressing rotator facing the heating and fixing rotator and configured to be rotatable and pressed against the recording medium;

a blower;

a guide having an air blowing port and configured to guide air sent from the blower to at least one of the heating and fixing rotator and the pressing rotator;

an opening and closing device configured to move to open and close the air blowing port of the guide; and a driving device including a driver configured to move the opening and closing device and to drive one or more of the pair of rotators, the driving device being configured to separately drive the opening and closing device and the one or more of the pair of rotators.

12. The image forming apparatus according to claim 11, wherein the driver is configured to drive the opening and closing device and the pressing rotator.

13. The image forming apparatus according to claim 11, wherein the opening and closing device is configured to move between an initial position at which the opening and closing device closes the air blowing port of the guide and an opening position at which the opening and closing device opens the air blowing port of the guide, and wherein the opening and closing device is configured to return to the initial position when a driving force is not applied thereto.

14. The image forming apparatus according to claim 11, wherein the opening and closing device is configured to move in a rotation axis direction of the pressing rotator.

15. The image forming apparatus according to claim 11, further comprising a driving force transmitter configured to be rotatable in a plurality of directions and rotate in one of the plurality of directions to transmit a driving force to the opening and closing device.

16. The image forming apparatus according to claim 15, wherein the driving force transmitter includes a one-way clutch.

17. The image forming apparatus according to claim 10, further comprising a driving force transmitter configured to be rotatable in a plurality of directions and rotate in one of the plurality of directions to transmit a driving force to the one or more of the pair of rotators.

18. The image forming apparatus according to claim 17, wherein the driving force transmitter includes a one-way clutch.

19. A fixing device comprising:

a pair of rotators including a heating and fixing rotator and a pressing rotator, the heating and fixing rotator heating and fixing rotator configured to be rotatable and heat an unfixed image on a recording medium to fix the unfixed image on the recording medium the pressing rotator facing the heating and fixing rotator and configured to be rotatable and pressed against the recording medium;

a guide having an air blowing port and configured to guide air to at least one of the heating and fixing rotator and the pressing rotator;

an opening and closing device configured to move to open and close the air blowing port of the guide; and a driving force transmitter configured to be rotatable in a plurality of directions and rotate in one of the plurality of directions to transmit a driving force from a driver to the opening and closing device, the driver being configured to also drive one or more of the pair of rotators, wherein the opening and closing device is configured to move between an initial position at which the opening and closing device closes the air blowing port of the guide and an opening position at which the opening and closing device opens the air blowing port of the guide.

20. The fixing device according to claim 19, wherein the driving force transmitter includes a one-way clutch.

21. The fixing device according to claim 19, further comprising another driving force transmitter configured to be rotatable in a plurality of directions and rotate in one of the plurality of directions to transmit the driving force to one of the heating and fixing rotator or the pressing rotator.

22. The fixing device according to claim 19, wherein the air blowing port includes a pair of air blowing ports, and the driver is configured to move a pair of shields included in the opening and closing device to simultaneously open respective ones of the pair of air blowing ports.

* * * * *